US008552663B2

(12) United States Patent
Welten

(10) Patent No.: US 8,552,663 B2
(45) Date of Patent: Oct. 8, 2013

(54) CONTROLLER FOR CONTROLLING AN LED ASSEMBLY, LIGHTING APPLICATION AND METHOD FOR CONTROLLING AN LED ASSEMBLY

(75) Inventor: Petrus Johannes Maria Welten, Oss (NL)

(73) Assignee: EldoLAB Holding B.V., Eindhoven (NL)

( * ) Notice: Subject to any disclaimer, the term of this patent is extended or adjusted under 35 U.S.C. 154(b) by 343 days.

(21) Appl. No.: 12/993,618

(22) PCT Filed: May 19, 2009

(86) PCT No.: PCT/NL2009/000120

§ 371 (c)(1),
(2), (4) Date: Feb. 4, 2011

(87) PCT Pub. No.: WO2009/142478

PCT Pub. Date: Nov. 26, 2009

(65) Prior Publication Data

US 2011/0121757 A1 May 26, 2011

Related U.S. Application Data

(60) Provisional application No. 61/054,661, filed on May 20, 2008.

(51) Int. Cl.
*G05F 1/00* (2006.01)

(52) U.S. Cl.
USPC ..... 315/307; 315/291; 315/360; 315/247; 315/312; 327/14; 327/16; 327/35; 345/204; 345/690; 345/691

(58) Field of Classification Search
USPC ..... 315/247, 291, 297, 224, 307, 312, 360; 327/7–10, 16, 17, 35, 50, 132, 427, 327/434, 436; 345/82, 204, 213, 690, 691
See application file for complete search history.

(56) References Cited

U.S. PATENT DOCUMENTS

| | | | | |
|---|---|---|---|---|
| 7,317,403 | B2 * | 1/2008 | Grootes et al. | 340/815.45 |
| 7,834,678 | B2 * | 11/2010 | Niessen et al. | 327/434 |
| 7,888,890 | B2 * | 2/2011 | Joos et al. | 315/308 |
| 8,063,581 | B2 * | 11/2011 | Van Der Wal et al. | 315/291 |
| 2008/0048587 | A1 | 2/2008 | Joos et al. | |

FOREIGN PATENT DOCUMENTS

| | | | |
|---|---|---|---|
| WO | WO 2007/054856 | A2 | 5/2007 |
| WO | WO 2007/148298 | A1 | 12/2007 |

OTHER PUBLICATIONS

International Search Report for PCT/NL2009/000120, May 19, 2009.

* cited by examiner

*Primary Examiner* — Haiss Philogene
(74) *Attorney, Agent, or Firm* — Hoffmann & Baron, LLP

(57) ABSTRACT

A controller for controlling an LED assembly is described. The controller is arranged to—receive an input signal representing a required characteristic of the LED assembly,—convert the input signal to a control signal for the LED assembly,—apply a correction to the control signal to obtain a corrected control signal, the correction being based on a predetermined transient characteristic of the LED assembly,—output the corrected control signal. As such, a better correspondence between a required characteristic and an actual characteristic of the LED assembly is obtained.

21 Claims, 7 Drawing Sheets

CONTROLLER FOR CONTROLLING AN LED ASSEMBLY, LIGHTING APPLICATION AND METHOD FOR CONTROLLING AN LED ASSEMBLY

CROSS-REFERENCE TO RELATED APPLICATIONS

This application is the National Stage of International Application No. PCT/NL2009/000120, filed May 19, 2009, which claims the benefit of U.S. Provisional Application No. 61/054,661, filed May 20, 2008, the contents of which is incorporated by reference herein.

FIELD OF THE INVENTION

The present invention relates to a controller for controlling an LED assembly, a lighting application and a method for controlling an LED assembly.

BACKGROUND OF THE INVENTION

At present, in architectural and entertainment lighting applications more and more solid state lighting based on Light Emitting Diodes (LED) is used. LEDs or LED units have several advantages over incandescent lighting, such as higher power to light conversion efficiency, faster and more precise lighting intensity and color control. In order to achieve this precise control of intensity and color from very dim to very bright light output, it is necessary to have accurate control of the forward current flowing through the LEDs.

In order to provide said forward current through the LED or LEDs, a converter (or a regulator such as a linear regulator) can be used. Examples of such converters are Buck, Boost or Buck-Boost converters. Such converters are also referred to as switch mode current sources. Such current sources enable the provision of a substantially constant current to the LED unit. When such an LED unit comprises LEDs of different color, the resulting color provided by the LED unit can be modified by changing the intensity of the different LEDs of the unit. This is, in general, done by changing the duty cycles of the different LEDs. Operating the LEDs at a duty cycle less than 100%, can be achieved by selectively (over time) providing a current to the LEDs, i.e. providing the LEDs with current pulses rather than with a continuous current. By appropriate selection of the duty cycle a required color and intensity can be provided. In order to provide a high resolution with respect to the intensity or color of the light source, a precise control of the current pulses is required to enable high-resolution LED lighting color or white mixing control.

In practice, a current source will not instantaneously provide an appropriate current but may need some time to reach the current set point, especially in the case of switch mode current sources. As such, when an LED unit is controlled to operate at a certain duty cycle, in order to generate a required intensity and/or color, the color or intensity that is actually obtained may be different from the required values because the actual current or current profile through the LEDs does not correspond to the required or expected values. This effect may occur when a current through the LED is turned on as well as when the current is turned off. In practice, turning the current through an LED on or off can be realized by opening or closing a low impedance connection parallel to the LED thereby redirecting the current either through the LED or through the low impedance connection. Opening or closing the connection can e.g. be realized using a FET or a MOSFET.

It can further be noted that a mismatch between a required characteristic and an actual characteristic may also be due to aging or thermal influences.

Due to the mismatch between the required and the actual characteristic, the contrast that can be obtained with respect to e.g. color or intensity, is reduced. This can be understood as follows: In practice, the contrast with respect to e.g. the intensity of an LED can be represented by the minimal intensity that can be provided. Due to the transient behavior of the converter powering the LED or e.g. manufacturing tolerances affecting the LED characteristics, a large spread can be observed between different LEDs of the same product line. Therefore, in order to ensure that all LEDs of the same product line perform in the same way, the minimum intensity may need to be set comparatively high in order to ensure substantially the same behavior of different LEDs. As such, tolerances and transient behavior may affect the contrast available for the product line.

Furthermore, in the case of switch mode current sources, the internal switch mode control frequency is, in general, independent of the pulse turn-on or turn-off moment. This means that for short pulses, under about 5 times the length of the switcher cycle, the current pulse may have an uncertain start that leads to large differences in actual current output.

It may be acknowledged that precise current control may be achieved in the current state of the art by using special components with low temperature drift and high accuracy, thereby alleviating or mitigating some of the effects mentioned. Such an approach is however rather expensive and therefore not preferred.

SUMMARY OF THE INVENTION

In view of the above mentioned drawbacks, it is an object of the present invention to provide an improved way of operating an LED assembly and to provide a controller for an LED assembly that, at least partly, overcomes one or more of the drawbacks as mentioned.

According to an aspect of the present invention, there is provided a controller for controlling an LED assembly, the controller being arranged to

- receive an input signal representing a required characteristic of the LED assembly,
- convert the input signal to a control signal for the LED assembly,
- apply a correction to the control signal to obtain a corrected control signal, the correction being based on a predetermined transient characteristic of the LED assembly,
- output the corrected control signal.

By controlling an LED assembly using a controller according to the present invention, a better correspondence between the required characteristic and the actual characteristic of the LED assembly can be obtained because of the applied correction to the control signal. The correction applied is based on a predetermined transient characteristic of the LED assembly. As an example of such transient characteristic of the LED assembly, a current transient can be mentioned. In general, an LED assembly as controlled by the controller according to the invention comprises an LED or an LED unit comprising one or more LEDs and a converter for powering the LED or LED unit. As such, a characteristic of the LED assembly may comprise either a characteristic of the LED or LED unit (e.g. an intensity or a colour) or a characteristic of the converter (such as a current or current profile or pulse). The correction as applied to the control signal in order to obtain the corrected control signal can e.g. be obtained from current or voltage measurements performed on the assembly. By providing the corrected control signal rather than the control signal, an improved control of the LED assembly is obtained in that a better correspondence between the required characteristic and the actual characteristic of the assembly is obtained. As such, when a better control can be established with respect to the actual performance of the LED assembly, an improved contrast (i.e. a lower minimal brightness) can be obtained. A better control of the current pulse enables the minimal pulse available to be set at a lower value. As such, a substantially similar behaviour of different LEDs of the same product line can be obtained, even at the minimal brightness. As a result, the contrast that can be obtained for the product line is improved.

According to an other aspect of the present invention, there is provided a method of controlling an LED assembly, the method comprising the steps of

- receiving an input signal representing a required characteristic of the LED assembly,
- converting the input signal to a control signal for the LED assembly,
- applying a correction to the control signal to obtain a corrected control signal, the correction being based on a predetermined transient characteristic of the LED assembly,
- outputting the corrected control signal.

In a preferred embodiment of the method according to the present invention, the correction to the control signal is determined by

- applying a signal to the LED assembly corresponding to a required characteristic of the LED assembly,
- determine the actual characteristic of the LED assembly from a response to the signal,
- determine a difference between the actual characteristic and the required characteristic,
- determine from the difference the correction applicable to the control signal to at least partly compensate the difference.

According to the preferred method of the present invention, the behaviour of the LED assembly in response to a control signal is characterised by comparing the expected (or required) characteristic of the assembly with the actual characteristic that occurs. From this comparison, a correction can be determined which, when applied to the control signal provided by the controller, results in a better correspondence between the required characteristic and the actual characteristic. As mentioned above, the required characteristic of the LED assembly can refer to either a characteristic of an LED or LED unit of the assembly or to a characteristic of the converter or regulator of the assembly. To illustrate this, the following example is given.

In order to obtain a required intensity of an LED, a control signal for a converter of the LED assembly may enable the converter to supply a current pulse (with a specific amplitude and duty cycle) to the LED. In practice, the shape of the current pulse can be different from the expected shape resulting in a different intensity of the LED (e.g. due to the transient behaviour of the converter). As such, the difference between the actual intensity and the required intensity can be observed and determined either directly from the intensity (e.g. by an intensity measurement) or indirectly from the current shape (e.g. by measuring the actual current pulse shape and comparing it with the expected current pulse shape).

In both cases, a correction can be determined from the observed difference, said correction being such that the difference between the required characteristic and the actual characteristic is reduced.

As in general, the mismatch between e.g. an actual intensity and a required intensity is such that the actual intensity is lower than required, the mismatch may also be referred to as duty-cycle losses or turn-on losses.

Embodiments and further advantages of the present invention are described further on and illustrated by the following figures.

DETAILED DESCRIPTION OF THE INVENTION

At present, more and more solid state lighting applications based on Light Emitting Diodes (LED) are used. LEDs or LED units have several advantages over incandescent lighting, such as higher power to light conversion efficiency, faster and more precise lighting intensity and color control.

The output, in terms of color or intensity of such LEDs or LED units is controlled by controlling the current through the LED or LEDs.

Figure 1A:
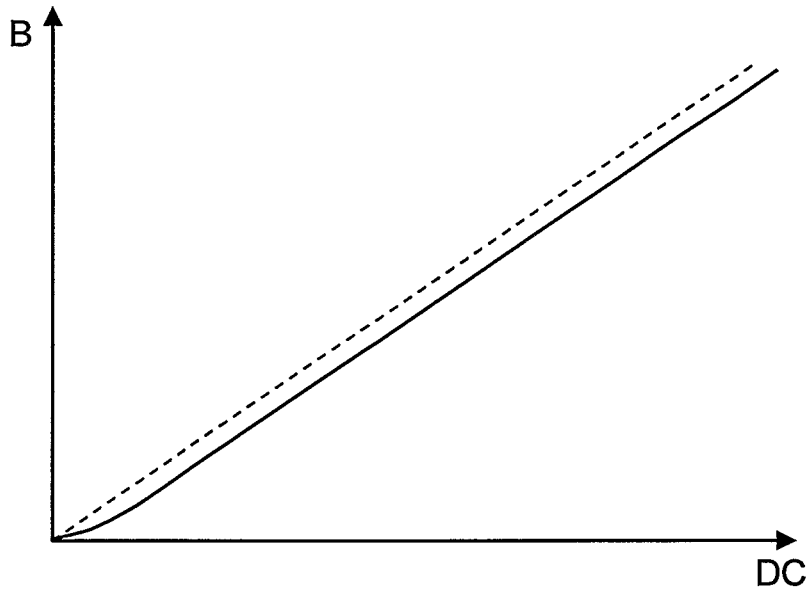
FIG. 1*a* schematically depicts a brightness vs. duty-cycle graph for a PWM control scheme.

Current state of the art typically uses Pulse-Width Modulation (PWM) where at a fixed frequency the duty cycle of the LED current is varied. Due to the discussed losses, the resulting brightness will not be linear with the duty cycle set-point when varied from 0 to 100%. At lower duty cycles, the brightness versus duty cycle set-point curve will rise slower than at higher duty cycles. This is due to the fact that the current will not rise to its nominal value Inom because of the short duration of the required current pulse. As soon as the current is able to reach its nominal values Inom, the final slope in the said curve is reached and the brightness will rise with that slope until 100% duty cycle is reached. This is illustrated in FIG. 1*a* schematically showing the brightness B as a function of the duty-cycle DC. The dotted curve represents the required or expected relationship, the solid line represent the actual relationship that is obtained when the current source is not able to instantaneously provide a required current set-point.

Given a certain resolution used to change the duty cycle set-point, a certain minimum brightness level is attained when the duty cycle is increased from 0 by 1 resolution step. The higher the resolution, the more this said minimum brightness is influenced by the non-ideality of the leading and trailing current slopes of a current pulse and the typically Gaussian distribution thereof. At high resolutions it may even be so that some LEDs do transmit light while others don't after an increase of the duty cycle from zero by 1 resolution step. It can either be accepted that it takes more resolution steps before LEDs light up or, the resolution is chosen less high, leading to more coarse brightness and color control.

In any case, the resulting contrast (the quotient between 100% brightness and minimal brightness) is either dependent on the LED's and converter's characteristics determining the current slopes, or may be only reached at different duty cycle settings over LED (or LED unit)+converter instances or is lower than could be the case because of the choice for a lower resolution.

This known approach (Pulse-Width Modulation) may therefore limit the resolution that can be obtained compared to a non-fixed-frequency control, the known approach may have a non-linear brightness versus set-point behavior and can make it difficult to position the control unit controlling the converter as a building block with consistent behavior independent of different LED topologies used.

Assuming Pulse-Width Modulation with a period Tp and a smallest duty cycle step tr, the resolution is limited to Tp/tr.

Figure 1B:
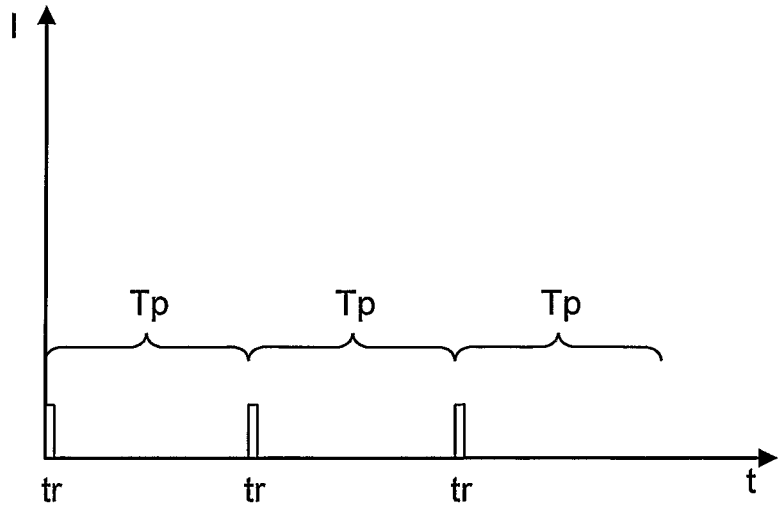
FIG. 1*b* schematically depicts a PWM control scheme.

FIG. 1*b* schematically illustrates a current I vs. time graph showing several periods Tp and current pulses having a length (in time) equal to tr.

Figure 1C:
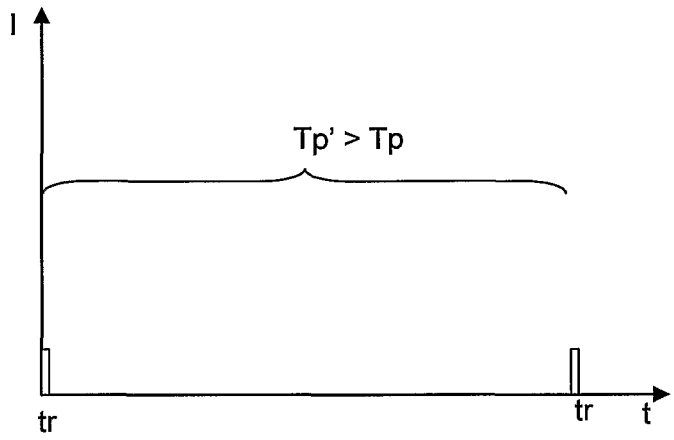
FIG. 1*c* schematically depicts a first example of a variable frequency scheme.
Figure 1D:
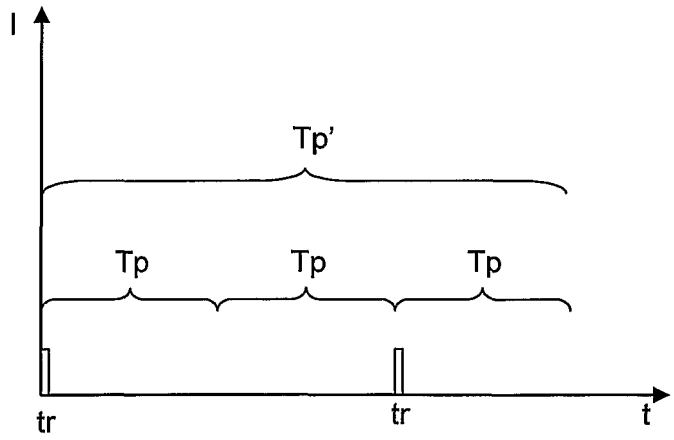
FIG. 1*d* schematically depicts a second example of a variable frequency scheme.

When a non-fixed (or variable) frequency control is applied, a larger period, referred to as Tp', can be applied, see FIG. 1*c*. As such, an increased resolution Tp'/tr is obtained. Period Tp' may also be selected to encompass multiple periods Tp while maintaining tr as smallest duty cycle step with said period Tp'. For each period Tp, it can be decided to apply a pulse tr or not. As such, an increased resolution may equally be is obtained. This is illustrated in FIG. 1*d* where Tp' equals 3 times Tp and two pulses tr are applied during period Tp'. In practice, Tp' can be enlarged up to the point where it becomes noticeable to the human eye (this occurs approx. between a frequency of 100 to 250 Hz).

Figure 1E:
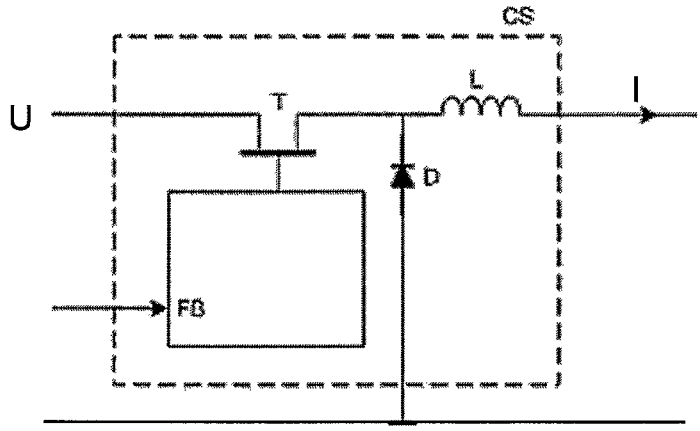
FIG. 1*e* schematically shows a state-of-the-art switch mode current source for driving an LED or LED unit.

At present, different types of current sources are applied for such controlling an LED or LED unit. FIG. 1*e* schematically shows an example of such a state-of-the-art current source CS for driving LEDs. The example as shown is known as a so-called buck-regulator. Using such a regulator, dimming of the LED can e.g. be established by duty-cycle based modulation (e.g. PWM). It is further acknowledged that other types of power sources (also referred to as regulators or converters) such as boost, buck-boost, CUCK, SEPIC or other, either synchronous or non-synchronous may advantageously be applied in combination with the present invention. In general, such a switched mode current source CS comprises an inductance L, a unidirectional element D such as a diode and a switching element T, e.g. a FET or a MOSFET. The switching of the element T can e.g. be controlled by a controller, based upon an input signal FB received by said controller.

Figure 2:
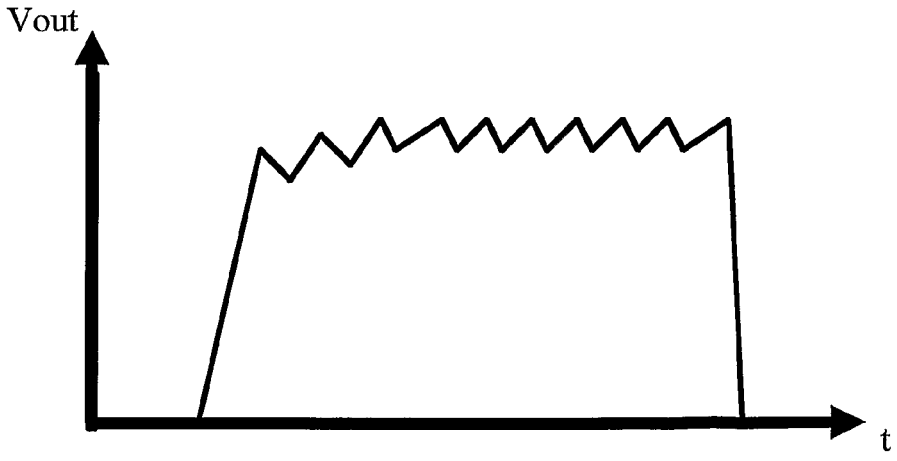
FIG. 2 schematically shows a graph of an output voltage transient of a switch mode current source.
Figure 3:
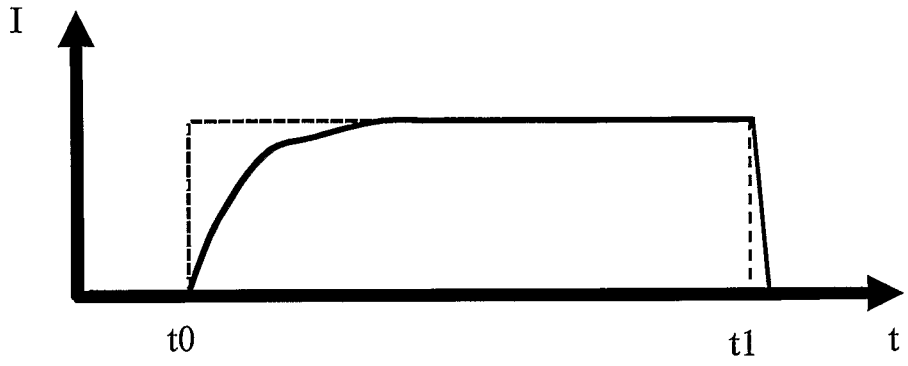
FIG. 3 schematically shows a graph of the actual current output over time corresponding to the voltage transient of FIG. 2.

FIGS. 2 and 3 schematically depict an output voltage Vout transient (FIG. 2) and output current I transient (FIG. 3) of such a regulator (or converter) corresponding to a required output change from current I=0 to current I=Inom. The sawtooth pattern that can be observed in the voltage transient characteristic of the current source (FIG. 2) is due to the switching of the switching element of the regulator. This switching can e.g. take place at a frequency of 500 kHz. The actual current I as a function of time t as provided by the current source (e.g. corresponding to the current through the LED unit) is shown by the solid line in FIG. 3. The dotted line corresponds to the actual current demand based on a control signal controlling the regulator. As can be seen, both during the rise from I=0 to I=Inom and during the fall from I=Inom to I=0, a difference can be observed between the actual current and the requested current.

Figure 4:
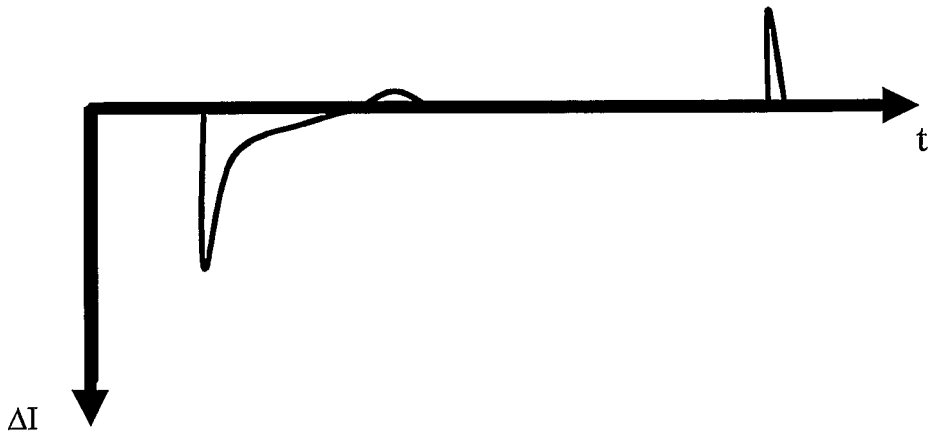
FIG. 4 schematically shows the difference between the actual current and the demand current shape.

FIG. 4 schematically depicts the difference ΔI between the requested (or required) current and the actual current as a function of time t. As can be observed, a difference between the actual current and requested current occurs both at the beginning of the current pulse and at the end. In general, the discrepancy at the beginning of the pulse will be larger than the discrepancy at the end of the pulse. Often, the difference between the actual and required current at the end of the pulse can be ignored. Overall, it can be observed that the actual current provided over time is smaller than the required current. In other words, the integral over time of the actual current pulse is smaller than the integral over time of the required current pulse. As this will, in general, result in a reduced intensity or a loss of intensity of the LED or LED unit, this effect is further on also referred to as turn-on or duty-cycle losses.

The present invention provides in various ways to prevent these turn-on or duty-cycle losses from impacting the overall required duty-cycle. One way to achieve this is to measure the current (turn-on) profile and compensate for this. Such compensation can in practice be realized by adjusting the control signal controlling the converter of the LED assembly: When turn-on losses are observed and determined, a correction that can be applied to the control signal, can be determined. When the correction is applied to the control signal, thereby obtaining a corrected control signal, this corrected control signal can be applied by a controller according to the invention to control an LED assembly. Such a corrected control signal can e.g. result in an increase of the duty-cycle, e.g. by extending the current pulses or by providing additional pulses.

Figure 5:
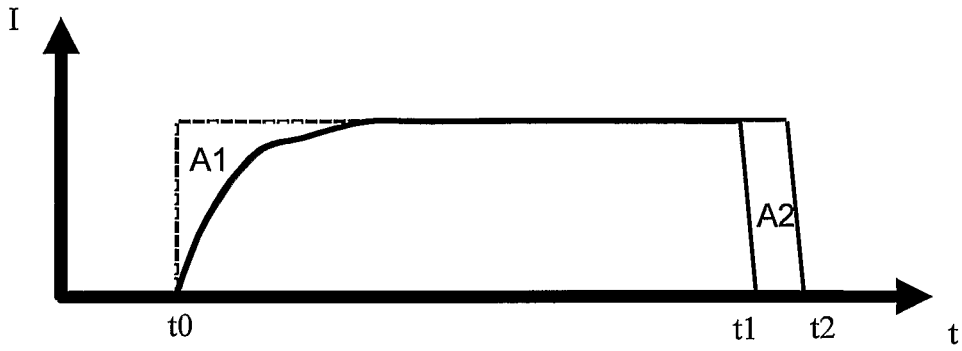
FIG. 5 schematically shows a compensated current pulse by lengthening the pulse in order to compensate the determined turn-on losses.

FIG. 5 schematically depicts the application of a corrected control signal corresponding to an extended current pulse. By applying an extended current pulse (from t0 to t2), the observed turn-on losses can, at least partly, be compensated. The extension of the current pulse can be selected such that area A2 substantially equals area A1.

In order to determine the turn-on losses, the actual current provided to the LED or LED unit can be measured.

Figure 6A:
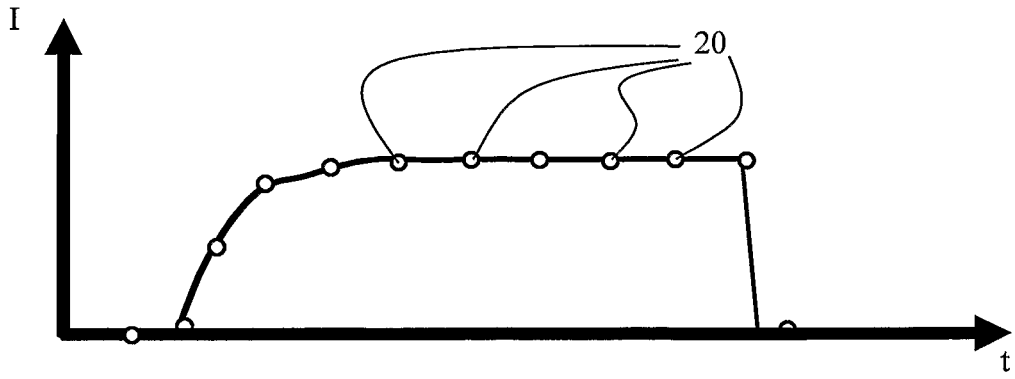
FIG. 6*a* schematically shows a way of determining the duty-cycle losses by current measurements.

This can be done in various ways. As a first example, the determination of the duty-cycle losses can be done by performing a plurality of current measurements within the current pulse under investigation. This is illustrated in FIG. 6*a*. FIG. 6*a* schematically discloses the actual current shape and a number of current measurements (20) indicated along the current shape. By interpolation, the integral over time of the current can be determined and compared to the required current shape.

In order to perform the current measurements of FIG. 6*a* a relatively fast A/D conversion may be required, preferably a factor of approx. 2 to 16 times faster as the switching frequency of the converter (in case of a switcher frequency of 500 kHz, a sampling of over 2 MHz is preferred in order to prevent aliasing effects).

Figure 6B:
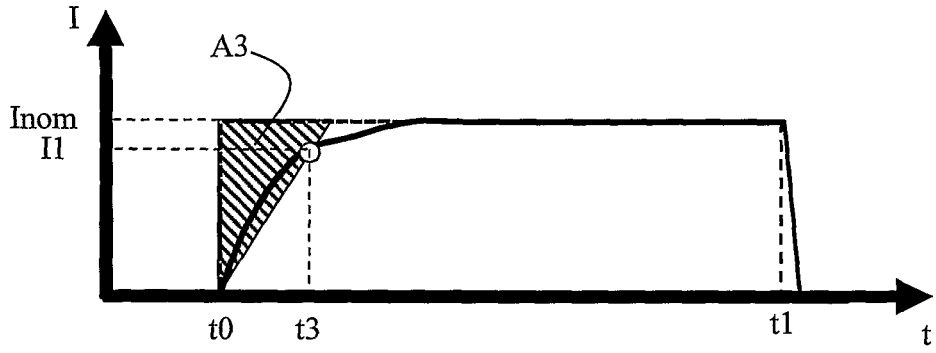
FIG. 6*b* schematically shows a first order approximation of determining the duty-cycle losses by current measurements.

As a first approximation to determine the turn-on losses, it will be appreciated that these losses can be calculated from the rise time of the current pulse. This rise time (i.e. the time required for the current to rise from I=0 to I=Inom) can be determined or approximated when the slope of the current pulse is know. This is illustrated in FIG. 6*b*. When the starting point (in time) t0 of the current pulse is known, the current slope can be approximated by a single current measurement at an instance t3, as illustrated. In case Inom, the time difference (t3–t0), and I1, the current measured at t3 are known, the area A3 can be determined from the slope of the current pulse (I1 over (t1–t0). Compensating the area A3 can be considered a first order approximation for the turn-on losses.

It is worth mentioning that a determination of the slope of the current pulse may advantageously be applied for an other purpose as well. As is e.g. illustrated in FIG. 7, an LED assembly may comprise multiple LED units, each of said LED units may have a different topology (e.g. multiple LEDs in parallel or multiple LEDs in series). Initially, the actual topology of an LED unit that is to be powered by a converter may be unknown. This may be the case when an LED unit is replaced. In such event, when a current is provided to the LED unit, the slope of the current pulse (that can be measured as e.g. illustrated in FIG. 6*b*) can be used to determined the topology of the LED unit. It has been observed that when a current slope $\alpha$ is known in case the LED unit comprises a single LED, the current slope observed when x LEDs are connected in series substantially equals $\alpha/x$. As a consequence, based on the known current slope $\alpha$ for a single LED, the topology of an unknown LED unit can be diagnosed and the corresponding turn-on losses for the LED unit can be estimated. It will be apparent to the skilled person that the turn-on losses as approximated using the method as illustrated in FIG. 6*b* are inversely proportional to the current slope $\alpha$ that is observed. Therefore, when the turn-on losses are known for a single LED, they may equally be determined (or estimated) for two or more LEDs. Experiments have shown that the described method provides good results at least up to 4 to 6 LEDs connected in series.

An alternative and preferred implementation to determine the actual current pulse shape is to measure fewer points (or even a single point) per current pulse and running a number of current pulses with each time the sample moment shifted by e.g. 0.5 us. The sampling moments are in time always referenced (and synchronized) to the start of the current pulse. In effect this acquires mostly the same result as if sampling of 2 MHz or more was used. The advantage is less stringent software and A/D conversion timing requirements. By interpolation of the multiple current measurements, the integral over time of the actual current pulse can be determined and compared to the required current shape. From this comparison, a correction (e.g. in the form of an extension of the current pulse) can be determined.

Figure 8:
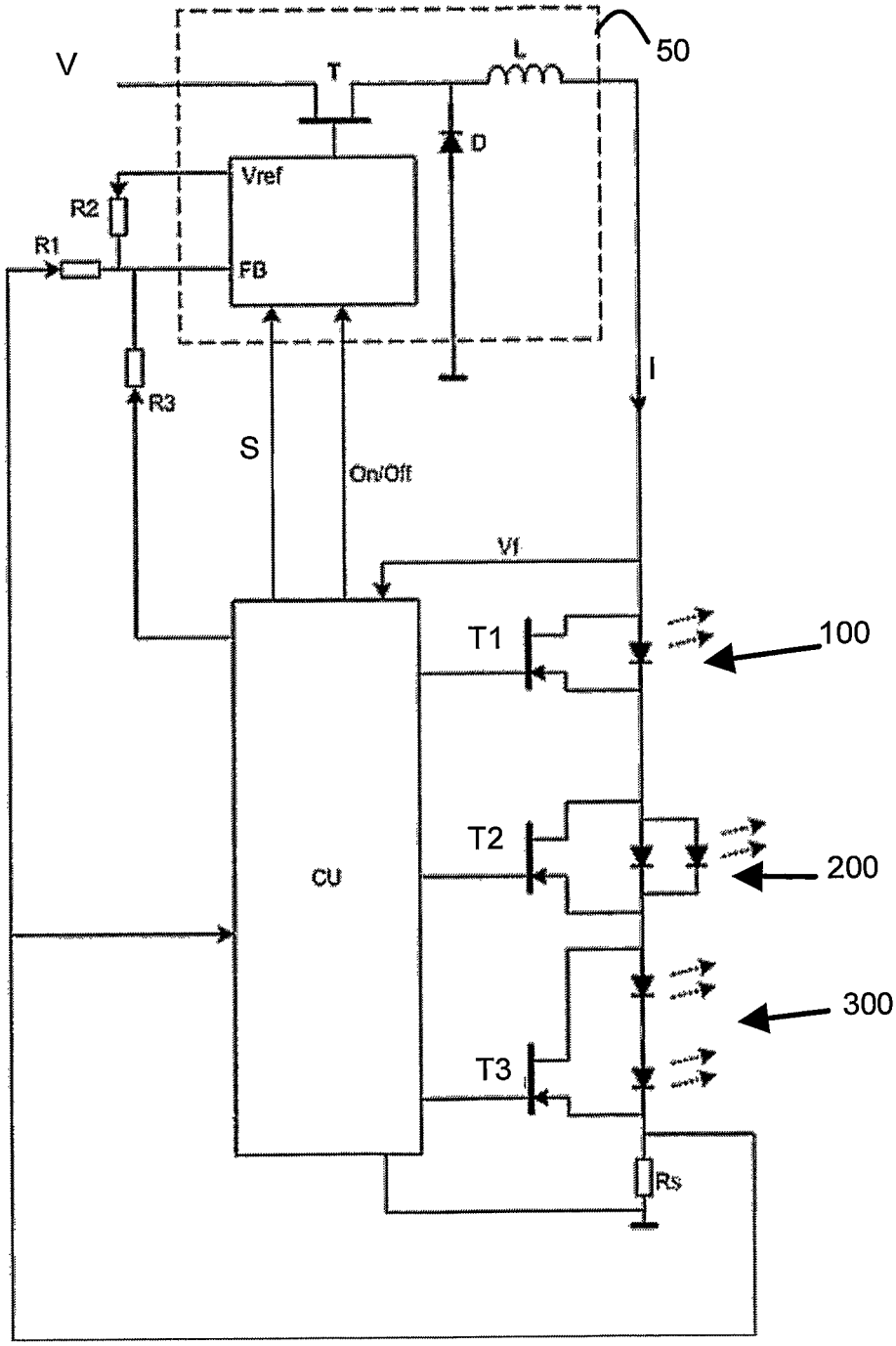
FIG. 8 schematically shows a lighting application according to the present invention.

With respect to the latter method, which is also known as subsampling, it should be noted that an accurate knowledge of the timing of the different pulses used to construct the current pulse shape is required. As the subsampling requires that several current measurements are made at predetermined intervals within a pulse, an accurate start of the pulses used for the subsampling needs to be known. In case a switched mode current source is used, it has been observed that the transient behavior, i.e. the actual shape of a current pulse can depend on the timing of the current pulse relative to the switching of the converter. As such, in order to ensure that the current pulse shape is consistent during the subsampling, one should ensure that the different pulses that are used occur at substantially the same instance with respect to the switching of the converter. This can be realized in practice by synchronizing the switching of the converter by the controller. In FIG. 8, such synchronizing is indicated by a sync-signal (S) provided by the controller CU to the converter (or regulator) 50. When a synch-signal is provided to the converter, the switch of the converter is operated. Subsequently, a control signal can be provided to the converter to provide the current pulse. As such, the current pulses can be synchronized with the switcher frequency. By doing so, one can ensure that the current pulse shape substantially remains the same thereby substantially obtaining the same duty-cycle losses for each pulse. In addition, one can ensure that the current pulse position in time with respect to the sync-signal is known. By doing so, the compensation or correction of these losses will be more consistent.

This may advantageously be applied to prevent a loss in resolution. By locking the frequency of the switcher or switching element T of the converter to the controller synchronization signal (or sync-signal) a consistent pulse shape can be generated. It has been observed that short pulses generated with independent frequencies of the switcher and the pulses themselves would lead to intensity variations that can be seen as flicker. When the switcher frequency is locked to the pulse start the resulting turn on and turn off waveforms substantially repeat the same slope and shape, reducing flicker by guaranteeing identical current pulse start slopes. As mentioned above, a switch mode power supply can be synchronized by resetting its switching frequency generator thereby locally synchronizing the phase of the two states.

In order to compensate for the duty-cycle losses, the measured current loss resulting from turning on the current, the current pulse can be lengthened such that the turn-on losses are compensated by the trailing end of the pulse.

Rather than correcting the control signal such that the current pulse is extended in time, it will be appreciated that the correction may also provide in correcting the losses by increasing the amplitude of the current to the LED or by controlling the current source such that an additional current pulse is supplied. Note that turn-on losses in such an additional current pulse are preferably also taken into account.

With respect to the transient characteristic behavior of the LED assembly, it is worth noting that different transient characteristics can be observed in an LED assembly. Assuming the LED assembly comprises a converter (e.g. a buck converter) for providing a current to an LED unit of the LED assembly, the LED unit comprising a plurality of the LEDs that can be provided with a current from the converter. Further assume that each of the LEDs of the LED unit can be short-circuited by a switch (e.g. a MOSFET). Such an LED assembly is described in more detail in FIG. 8.

In such an assembly, a current pulse can be provided to the individual LEDs in one of the following manners:

1. by switching on the current source (i.e. the converter) for a predetermined period.
2. assuming that a current is provided by the current source to a low impedance connection parallel to the LED (e.g. a MOSFET in a conducting state), a current can be provided to the LED by temporarily opening, for a predetermined period, this low impedance connection.

The first method of providing a pulsed current to the LED or LEDs is often applied when the LEDs are to operate at a low duty cycle. In such a situation, it would not be economical to provide a substantially continuous current to the LED unit whereas this current is only provided to the LEDs for a small percentage of the time (i.e. operating at a low duty cycle). It will be appreciated by the skilled person that the turn-on losses occurring may be different for both situations. In general, providing a current pulse by switching the current source will result in more turn-on losses compared to the losses occurring when the current is merely redirected. As such, in a preferred embodiment of the present invention, the correction applied to the control signal depends on the way the current is provided to the LED or LEDs. In addition, it has been observed that the transient behavior of the LED assembly can be affected by other parameters such as e.g. the timing of a current pulse relative to the switching (see FIG. 2) of the regulator. As such, timing aspects of a current pulse relative to the switching of the regulator may also be taken into account in the correction of the control signal. It will be appreciated by the skilled person that these various dependencies can be determined experimentally and that the results can e.g. be stored in a memory unit of the controller.

Rather than determining the correction of the control signal from the current difference between the required current (pulse) and the actual current (pulse), the difference in required characteristic and actual characteristic can be determined otherwise. In case the required characteristic is an intensity, this characteristic can be measured and, based on the LED driver specifications, a correction to the control signal can be determined. By doing so, a spread between the behavior of different LEDs of the same product line can be reduced and the resolution that can be obtained is increased.

Rather than using a current measurement to determine the turn-on losses (in general, a difference between a required and an actual characteristic of the LED assembly), other measurements may equally be applied. As an example, it may be advantageous to derive the turn-on losses from a measured voltage (or voltage profile), e.g. the forward voltage over the LED. Assuming that a block-shaped current pulse is required, it will be understood by the skilled person that the forward voltage over the LED should be block-shaped as well. As such, the actual voltage over the LED can be used to derive the turn-on losses and thus to obtain a correction to be applied to the control signal.

As an alternative to determining the turn-on losses occurring due to the fact that the rise time of the current is not infinitely small, it may be advantageous to control the slope of the current pulses by ensuring that the rise or fall of the current does not occur faster than a predetermined value. By controlling the slope of the current pulse, a better correspondence between the actual and required output characteristic may be obtained. By controlling the slope, turn-on losses can be avoided to a large extent. As illustrated in FIGS. 2-5, the turn-on losses can be regarded as a transient or parasitic effect due to an inadequate response of the LED assembly to the control signal. With other words, the LED assembly, e.g. the converter, is not able to follow the required output, e.g. a block-shaped current pulse. When however, a triangular or trapezoidal pulse shape would be required, the LED assembly may be able to provide this current shape with less turn-on losses.

In order to obtain a controlled rise and fall of the current through the LED or LEDs, it will be clear that this could be obtained by providing an appropriate control of the converter that powers the LED or LEDs, e.g. by providing a required current set-point (e.g. a predetermined profile) for the current. Providing such a current set-point and enabling the convertor to follow such a set-point may however add to the complexity of the controller and converter. In a preferred alternative, the LED assembly is constructed in such manner that the current rise or fall is limited by an appropriate circuit. An example of such a circuit is illustrated in FIG. 7.

Figure 7:
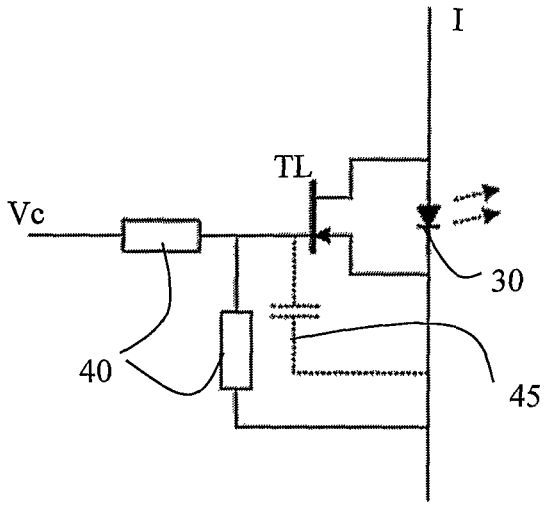
FIG. 7 schematically shows a circuit for controlling a current pulse slope as can be applied in the present invention.

FIG. 7 schematically depicts a switch TL (e.g. a MOSFET) in parallel with an LED 30. Providing a current pulse to the LED 30 can be realized by temporarily opening the parallel connection provided by the MOSFET. This can be established by controlling the voltage Vc e.g. by a control unit CU as shown in FIG. 8. The resistance circuit 40 together with the so-called Miller capacitance 45 of the MOSFET ensures that the voltage Vc is not instantaneously applied to the gate of the MOSFET. As a result, the parallel connection formed by the MOSFET is gradually opened and closed rather than substantially instantaneously. By an appropriate selection of the resistances 40, a controlled current slope of the pulses provided to the LED or LEDs can be realized.

It will be apparent to the skilled person that FIG. 7 merely provides an example how such a controlled current slope can be realized.

Although the application of a controlled current slope may provide an important improvement to the occurrence of the turn-on losses, it will be appreciated that a further reduction of the turn-on losses can be obtained when the application of a controlled current slope is combined with the determination and application of a correction to the control signal as illustrated by FIGS. 2-5. Also in this case, the correction may take the form of lengthening the current pulse, or providing an additional pulse.

With respect to the use of a controlled current slope, it is important to emphasize that this does not result in a loss of resolution of the required characteristic of the LED assembly.

The use of a controlled current slope has been found to provide an additional advantage in that it may result in a reduction of the noise produced by the converter.

When a current is applied to the inductance L of the converter, (see FIG. 2), forces are exerted on the different windings of the inductance. Said forces may result in displacements of the different windings, said displacements may result in audible noise. By limiting the variation of the current through the inductance, i.e. limiting the current slope, a noise reduction can be obtained. It will be appreciated by the skilled person that with respect to audible noise, the frequency of the source (i.e. the displacement of the windings) is also relevant. As is generally known, excitations having a frequency above 20 kHz are hardly heard. Therefore, it may be advantageous to ensure that the frequency content of the current through the inductance includes, as little as possible, any components below 20 kHz. In order to achieve this, the switching frequency of the current can be selected sufficiently high. Therefore, when a correction is applied to a control signal in order to reduce the turn-on losses, it may be advantageous to apply this correction by means of an additional pulse rather than by extending the current pulse. It will be acknowledged by the skilled person that by doing so, the frequency of the current spectrum can be raised.

The above described aspects of the present invention may advantageously be applied in a lighting application according to the present invention as schematically disclosed in FIG. 8. The lighting application as shown in FIG. 8 comprises a converter 50, an LED unit comprising multiple LEDs (the figure schematically depicts three LED groups 100, 200 and 300) and a controller CU arranged to control the converter 50. The current through each LED group is controlled by switches T1, T2 and T3 (e.g. MOSFET's) that can short-circuit the resp. LED groups 100, 200 and 300 thereby redirecting the current I provided by the converter from the LED group to the MOSFET.

The converter as shown in FIG. 8 is a so-called Buck converter. Although boost converters may equally be applied, it is worth mentioning that some specific advantages can be obtained when a buck converter, i.e. a step-down converter is used rather than a step-up converter such as a boost converter. In general, the converter used to power an LED unit is connected to a rectified voltage originating from the mains power supply, e.g. 230 V at 50 Hz.

The rectified voltage can directly be stepped down by a buck converter to e.g. 48 V whereas the use of a boost converter would require that the rectified input voltage is scaled down below the required output voltage for the LED unit.

Having a lower input voltage, the current requirements for a boost converter are therefore higher than for a buck converter, for a given power requirement to the LED unit.

Assuming the MOSFET's over the LED groups are open, the current through the LED groups can be determined from the voltage over resistance Rs, said voltage being provided to the controller CU. By monitoring the voltage during a current pulse or using a subsampling of a number of pulses, the voltage over the resistance Rs can be used to determine the duty-cycle losses.

Rather than using the current provided to the LED groups to determine the turn-on losses, these losses can also be derived from the forward voltage over the LEDs Vf (see FIG. 8).

As explained above, the control unit CU is arranged to provide a sync-signal to the converter, thereby locking the frequency of the switcher or switching element T. As a result, a consistent pulse shape can be generated. The control unit CU is further equipped to provide an On/Off signal to the converter 50 in order to turn the current source on or turn it down. As mentioned above, the voltage over resistance Rs is applied as a feedback to the control unit CU and to the converter (to the FB-port via the resistance R1). It will be acknowledged by the skilled person that, in order to control the switcher T of the controller, a voltage $V_{Rs}$ (=I*Rs) having a sufficient amplitude needs to be provided at the FB-input. When a current I is provided to the LED units, this current will result in unwanted dissipation in the resistance Rs. In order to mitigate the losses, the lighting application as shown in FIG. 8 is arranged to provide part of the voltage to the FB-input via a reference voltage Vref (and resistance R2). By doing so, the voltage drop over Rs can be selected smaller (for a given (nominal) current I), thereby reducing the dissipation occurring in the resistance Rs. The FB-input, that is applied as a feedback of the current I to the converter, may also be applied in the following manner to control the current of the converter: based on the input voltage on FB, the output current I is controlled; i.e. when the input voltage at FB is too low, the current will be increased, when the input voltage is to high, the current will be decreased. As can be seen in FIG. 8, the control unit CU can provide, via resistance R3, a voltage to the input FB of the converter. By doing so, the voltage at input FB of the converter can be raised to such level that the current provided by the converter will be decreased (regardless the actual value of the current I). As such, controlling the voltage provided via resistance R3 to input FB can be applied to control the current provided by the converter. It has been observed that this way of controlling the current may result in an improved transient behavior compared to turning the converter on or off using the On/Off signal.

It can further be noted that the correction that can be applied to the control signal to provide a closer match between the required characteristic and the actual characteristic can be determined at various moments. As an example, the correction can be determined by calibration in the factory. As such, the correction can be determined under various circumstances and provided to the controller, e.g. as a look-up table. Equally, the correction can be determined during a start-up, or even per pulse. The compensation of the turn-on losses may be used to compensate certain aging effects of the LED assembly as well. The determination of the turn-on losses (and corresponding correction) can take place at certain time intervals, e.g. once a month or each time the LED assembly is used.

A more sophisticated turn-on loss compensation may incorporate the "current-to-light" output transfer function to compensate for the difference in light output at lower current values with that at higher current values, f.e. using a model of this transfer function. Such a model can e.g. be incorporated in the controller CU as shown in FIG. 8.

It will be appreciated by the skilled person that the present invention may result in an increase in contrast compared to the state of the art and may result in a smaller spread between different LEDs or LED units of the same product line, as explained above. By examining the transient behavior of the LED assembly rather than circumventing it (e.g. by applying special components with low temperature drift and high accuracy) a more economical solution is obtained. Using the present invention, a current accuracy of 1% can be achieved without the use of expensive special components, In addition, the controller or control methods according to the invention can be arranged to take into account multiple aspects of the operating conditions of the LED assembly, such as switching transients and associated losses and aging effects.

The invention claimed is:

1. A controller for controlling an LED assembly, the controller being arranged to receive an input signal representing a required characteristic of the LED assembly;

convert the input signal to a control signal for the LED assembly;

apply a correction to the control signal to obtain a corrected control signal, the correction being based on a predetermined current slope of a current pulse of the LED assembly, the current slope occurring at a beginning and/or an end of the current pulse; and output the corrected control signal.

2. The controller according to claim 1 wherein the control signal comprises a current set point.

3. The controller according to claim 2 wherein the current set point comprises an amplitude and a duration of a current pulse.

4. The controller according to claim 3 wherein the correction represents an increase of the duration of the required current pulse.

5. A lighting application comprising an LED assembly comprising a converter arranged to, in use, provide a current to an LED unit; and a controller according to claim 1 for controlling the LED assembly.

6. The controller according to claim 1 wherein the current slope of the current pulse is determined from a forward voltage over an LED of the LED assembly.

7. The controller according to claim 6 wherein the current slope of the current pulse is determined by subsampling.

8. The lighting application according to claim 5 further comprising the LED unit, the LED unit comprising one or more LEDs, the LED unit being arranged to, in use, receive the current provided by the converter of the LED assembly.

9. The controller according to claim 1 wherein the correction compensates for turn-on losses due to the current slope of the current pulse.

10. The controller according to claim 9 wherein the correction further incorporates a "current-to-light" output transfer function.

11. The controller according to claim 1 wherein the correction is obtained by subsampling.

12. The controller according to claim 1 wherein the correction represents an additional current pulse.

13. The lighting application according to claim 5 wherein the controller is further arranged to receive a voltage over a resistance, the resistance in use receiving the current.

14. The lighting application according to claim 13 wherein the voltage over the resistance is further applied as a feedback signal to the converter, for controlling the current provided by the converter.

15. The lighting application according to claim 13 wherein the controller is further arranged to provide a further feedback signal, preferable via a further resistance, to the controller, for controlling the current provided by the converter.

16. The lighting application according to claim 14 wherein the feedback signal or further feedback signal is increased with at least part of a reference voltage.

17. A method of controlling an LED assembly, the method comprising the steps of receiving an input signal representing a required characteristic of the LED assembly;

converting the input signal to a control signal for the LED assembly;

applying a correction to the control signal to obtain a corrected control signal, the correction being based on a predetermined current slope of a current pulse of the LED assembly, the current slope occurring at a beginning and/or an end of the current pulse; and outputting the corrected control signal.

18. The method according to claim 17 wherein the current pulse is determined by a current measurement.

19. The method according to claim 17 wherein the current pulse is determined from a voltage measurement.

20. The method according to claim 17 wherein the correction to the control signal is determined by applying a signal to the LED assembly corresponding to a required characteristic of the LED assembly;

determining an actual characteristic of the LED assembly from a response to the signal;

determining a difference between the actual characteristic and the required characteristic; and determining from the difference the correction applicable to the control signal to at least partly compensate the difference.

21. The method according to claim 17 wherein the characteristic comprises an intensity or a colour.

* * * * *